US008327602B2

(12) United States Patent
Smith

(10) Patent No.: US 8,327,602 B2
(45) Date of Patent: Dec. 11, 2012

(54) METHOD AND SYSTEM FOR REMEDIATING AND COVERING WOOD FLOORS

(75) Inventor: Robert Walter Smith, Bartlett, IL (US)

(73) Assignee: Universal Floor & Wall Systems, Inc., Bartlett, IL (US)

( * ) Notice: Subject to any disclaimer, the term of this patent is extended or adjusted under 35 U.S.C. 154(b) by 28 days.

(21) Appl. No.: 12/791,532

(22) Filed: Jun. 1, 2010

(65) Prior Publication Data

US 2011/0061334 A1 Mar. 17, 2011

Related U.S. Application Data

(60) Provisional application No. 61/276,363, filed on Sep. 14, 2009.

(51) Int. Cl.
*E04B 1/00* (2006.01)

(52) U.S. Cl. ..... 52/741.4; 52/181; 52/454; 52/514.5; 52/515

(58) Field of Classification Search ..... 52/514, 52/514.5, 515, 741.1, 741.4, 181, 443, 446, 52/454, 361, 362, 363
See application file for complete search history.

(56) References Cited

U.S. PATENT DOCUMENTS

| | | | | |
|---|---|---|---|---|
| 2,246,101 | A * | 6/1941 | McEnany | 428/213 |
| 4,050,978 | A * | 9/1977 | Moore | 156/300 |
| 4,270,329 | A * | 6/1981 | Moore | 52/576 |
| 5,735,094 | A * | 4/1998 | Zember | 52/314 |
| 6,716,482 | B2 * | 4/2004 | Morton | 427/201 |
| 6,786,674 | B1 * | 9/2004 | Hanks | 404/32 |
| 6,925,766 | B2 * | 8/2005 | Di Pede | 52/408 |
| 7,833,575 | B2 * | 11/2010 | Gupta | 427/202 |
| 2006/0057345 | A1 * | 3/2006 | Surace et al. | 428/213 |
| 2009/0068473 | A1 * | 3/2009 | Van Wessel et al. | 428/416 |

FOREIGN PATENT DOCUMENTS

EP MX 2008006065 A * 10/2005

OTHER PUBLICATIONS

PCT Search Report, PCT/US11/038602 (corresponding case), Jan. 11, 2012.

* cited by examiner

*Primary Examiner* — William Gilbert
(74) *Attorney, Agent, or Firm* — Niro Haller & Niro; Clifford Kraft

(57) ABSTRACT

A method and system for covering industrial wood plank or wood block floors that can be installed quickly without creating a hazardous environment or hazardous wastes and without the necessity of removing installed equipment. Sand is swept over the wood to fill voids and cracks. Next metal lath is stapled to the wood. A first layer of epoxy is poured onto the metal lath. After this is dry, a second coat of finish epoxy, possibly colored as desired, can be installed on the first epoxy layer. When this dries, the job is done and operations can be restarted. The epoxy material used can be self-leveling for ease of application and the final floor is approximately level. In a particular embodiment, a layer of plastic can be placed over the floor before the lath is installed, and in another embodiment, the second layer of epoxy can be omitted.

16 Claims, 4 Drawing Sheets

1. SWEEP SAND OVER WOOD BLOCK TO FILL GAPS
2. LAY METAL LATH - STAPLE TO WOOD
3. APPLY 1ST EPOXY LAYER
4. ALLOW TO DRY
5. APPLY 2ND EPOXY LAYER

FIG. 4

METHOD AND SYSTEM FOR REMEDIATING AND COVERING WOOD FLOORS

The present invention is related to and claims priority from U.S. Provisional Patent Application No. 61/276,363 filed Sep. 14, 2009. Application No. 61/276,363 is hereby incorporated by reference.

BACKGROUND

1. Field of the Invention

The present invention relates generally to the field of remediating, replacing, sealing and covering industrial wooden floors, and more particularly to a method and system that installs a complete epoxy floor system attached to the original wood without the necessity of removing or preparing such floors for sealing and top coating.

2. Description of the Prior Art

Over the years, wood plank floors or wood block floors were installed in numerous commercial and industrial buildings. Many of those floors installed consist of wood blocks or wood planks that are treated with creosote, because creosote-treated wood resists shrinking, insect attack, moisture and decay. Wood floors also reduce sound reflection and provide a softer surface than concrete. Rooms in these buildings usually contain heavy machinery which is mounted to the floor and is in continuous operation. Complete replacement of these floors presents a tremendous problem because all use of the room, including the machinery, must be stopped, and all personnel must be temporarily relocated. Additionally, the large machinery must be removed piece by piece, and finally, the creosote-treated floor must be removed block by block. In the alternative, preparation of the floor for sealing involves sanding or grinding of the creosote coated wood which creates dust and hazardous airborne particles. In general, this is a very laborious process that creates fumes and dust containing creosote chemical components which are harmful to humans. In addition, any treated wood which is removed must be specially disposed of.

Some prior art methods have involved pouring of resinous materials directly on the surface, or, removing the wood and installing approximately three inches of concrete in order to replace the wood block and maintain the proper prior floor height. However, these methods do not work satisfactorily because creosote-treated surfaces resist adhesion, and the thin layer of concrete will crack under heavy loads, and, unless very thick or reinforced, the replacement concrete cannot support heavy traffic or machinery. Concrete replacement also has the disadvantage of a long curing time (28 days) before the floor can be put back into manufacturing use. Also, concrete needs seams for expansion and contraction which is undesirable to the building owners. Finally, concrete replacement adds time and expense to the process by requiring the removal of machinery during remediation.

Epoxy resin is a desirable material for a floor covering rehabilitation and refurbishment because it cures rapidly and seals; however epoxy will not adhere to treated wood. Many new types of high-grade epoxy resins are available that result in floors with high functionality and efficiency. These epoxy resins may contain colors for decorative appearance and can effectively protect steel, concrete and wood from deterioration due to moisture, cracking and, in the case of steel, corrosion. Epoxy resin floors achieve a high degree of water-tightness that leads to much longer durability. In general, epoxy yields a floor that is safe, and has a clean, pleasing appearance. It provides a skid-proof surface, even when wet, and is resistant to acids and other aggressive chemicals found in industrial settings. Epoxy floors are also very resistant to abrasion as well as chemical solvents such as gasoline, greases, thawing salts and general solvents. When secured to a wooden subfloor, the epoxy/wood combination provides a softer, resilient and impact-resistant surface.

It would be extremely advantageous to have a method and system where epoxy resin could be rapidly affixed to treated wood plank or wood block floors that solves the problem of adhesion to the covered material; that would not create hazardous airborne material or hazardous waste; and would not require removal of installed machinery and allow workers and production to resume work with minimal down-time.

SUMMARY OF THE INVENTION

The present invention relates to a method and system for remediating creosote or other chemically treated wood flooring by covering existing industrial wood plank or wood block floors quickly without creating a hazardous environment or generating hazardous wastes. The present invention can be installed without the necessity of removing installed equipment and can be completed within a short time frame.

First, a layer of sand is swept or otherwise laid over the wood to fill voids and cracks. Next, metal lath is stapled to the wood. A first layer of epoxy is poured on top of, and into, the metal lath. After this is dry, a second coat of finish epoxy, possibly colored as desired, is spread on the first epoxy layer. When this cures, the job is done, although specially requested colorings can be added to designate walkways or other special areas. The epoxy can be self-leveling so that the final floor is approximately level. In a particular embodiment, a layer of plastic can be placed over the sand before the lath is put down. In some embodiments of the invention, the second epoxy layer can be omitted.

DESCRIPTION OF THE FIGURES

Attention is now directed to several drawings that illustrate features of the present invention:

FIG. 4 lists the basic steps of the invention.

Figure 1:
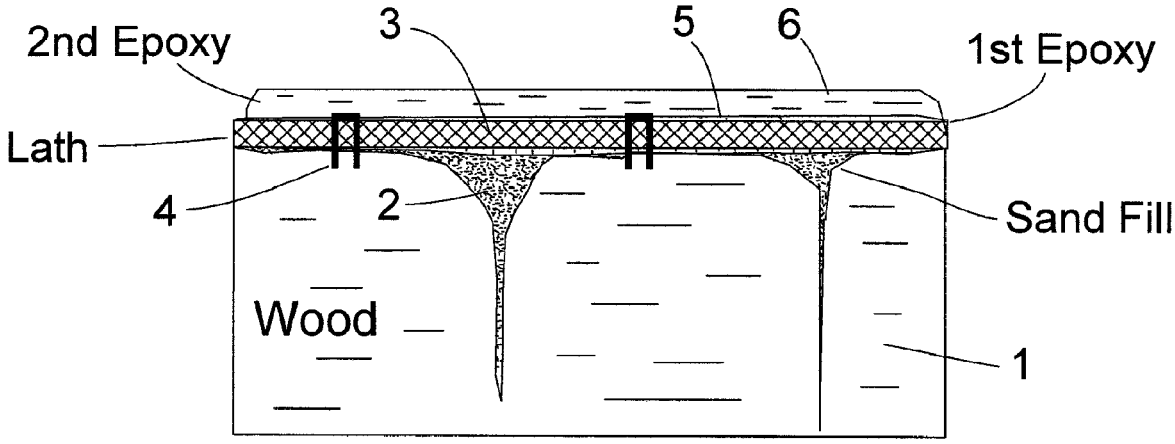
FIG. 1 shows a wood block floor with a sand fill, lath and two epoxy layers.

Several drawings and illustrations have been presented to aid in understanding the present invention. The scope of the present invention is not limited to what is shown in the figures.

DESCRIPTION OF THE INVENTION

The present invention relates to covering and sealing and remediating wooden floors in industrial buildings. The invention can be installed very quickly at a rate of around 10,000 sq. feet in a two day weekend. This high rate of installation minimizes production down-time. The present invention also does not require the removal of existing flooring or installed machinery. After the final epoxy layer cures, the room is ready for use. Many times, the floor can be covered and remediated over a weekend with workers returning on Monday morning able to resume work as normal. An entire large building can be completed in phases with little or no disruption to ongoing production. The preparation does not involve disturbing the chemically coated wood. The final floor does not emit undesirable odors or out-gas, will not crack, is impact resistant and resilient to mechanical and thermal shock and has no seams.

Wood plank or wood block floors, in industrial use are usually treated with creosote and usually contain many cracks, pits and voids. Generally, epoxy will not adhere to treated wood in this condition. The present invention allows the creation of an epoxy floor affixed to and covering such wood plank or wood block.

The first step in the present invention is to sweep sand over the planks or blocks to fill in any gaps, voids and spaces between the blocks. While a wide range of sand grits will work, the preferred sand is one that has small enough granules to fill all cracks and voids without creating excessive dust (of a mesh size between 20 and 80 sieve with 50 mesh being preferred). An example of a preferred sand is 50 mesh bank sand called sewing sand and sold by CORRO-SHIELD International, Inc. If the mesh size is too large, undesirable pockets are created; if it is too fine, it creates too much dust and is difficult to handle.

The second step is to lay galvanized metal lath over the wood block. The preferred lath is 4.5 gauge with a 2 inch overlap on each side. The lath can have a range of gauges from around 2.6 gauge to around 4.6 gauge. A 2.6 gauge mesh is the smallest mesh that has a ridge on the bottom. This ridge is important to keep the mesh up off of the wood so that epoxy can flow through and attach to the mesh. The lath is generally available 2.6 feet by 8 feet sheets. In some embodiments of the present invention, an optional layer of 6 mil plastic sheeting can be laid over the wood and sand before installation of the lath. This acts to separate the first epoxy layer from the surface of the wood.

Next, the metal lath is stapled to the wood with large metal flooring staples. While any large staple can be used, the preferred staples are 2 inch in length. The preferred application of the staples is at least 200 staples per sheet of lath. The staples act to hold the lath firmly to the wood. While staples are the preferred way to hold the lath to the wood, any other fastening technique known in the art may be used including nails, screws with washers and any other means of fastening.

The next step is to apply approximately 3/16 inch to around ¼ inch of self-leveling epoxy, containing 100% solids with an elongation of at least 15-16% over the wire mesh lath. This can be poured onto the mesh and spread with a squeegee or similar device. This will allow the epoxy to flow through the wire and onto the plastic, if used. This layer of epoxy should just cover the lath. A preferred epoxy is sold by CORRO-SHIELD International, Inc.

Optionally, when the first epoxy layer is cured and dry, it can be sanded or ground to make sure there is not protruding metal and that will have a slightly rougher surface for bonding to a final epoxy layer.

Finally, a second finishing coat of 100% self-leveling epoxy is laid on the first coat. This coat should also have an elongation of at least 15-16% at a rate of around 35 sq. feet per gallon. The final epoxy layer can be colored if desired. The thickness of the final layer can be similar to that of the first layer. The total epoxy thickness of the finished floor can be adjusted according to the expected load. A lightly loaded floor can have a thickness of around ⅛ inch, while a heavily loaded floor (heavy machinery on the floor) or around ½ inch.

The present invention generally does not bond epoxy to the wood; rather, the epoxy bonds to the lath which is held in place by the staples or other fasteners in the wood flooring.

FIG. 1 shows a typical installation of the present invention. A wood block floor 1 is first covered with a layer of sand which is swept over the wood to fill any voids 2, and a metal lath mesh 3 is placed on top of the wood. Large staples 4 are driven into the wood through the lath holding the lath in place. Again, typically two hundred 2 inch staples 4 are used for each 2.6 feet by 8 feet sheet of lath. Different sized staples can be used with 2 inch staples being preferred, and different sized lath sheets can be used as previously discussed. When the lath is installed, it should overlap each side by about 2 inches. After the lath 3 is in place, it is covered with at least one layer of epoxy 5 allowing the epoxy to fill all the voids and mesh area in the lath. After the first epoxy layer 5 cures, it can be optionally sanded or ground to remove any protruding metal from the lath, and to roughen the surface to receive a second epoxy layer 6. A second layer is then applied. When the second epoxy layer 6 cures, the job is complete.

Figure 2:
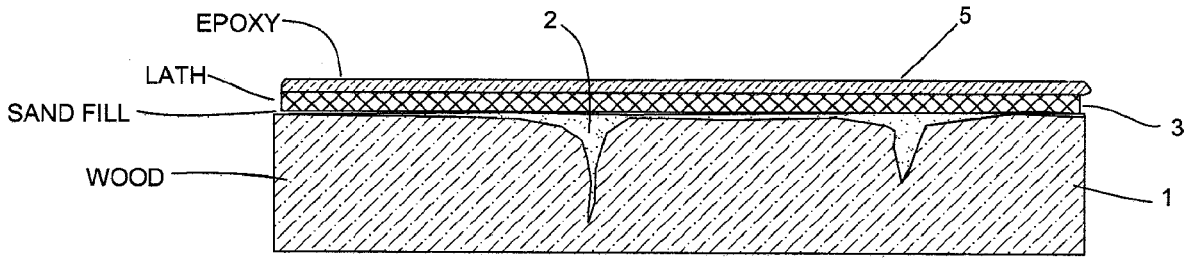
FIG. 2 shows an embodiment of the invention with sand, lath and one epoxy layer.

FIG. 2 shows details of the floor in FIG. 1 with only one epoxy layer. Again wood 1 is first covered and with swept with sand 2 to fill voids and then metal lath 3 mesh is stapled on top of the wood. The one epoxy layer 5 is applied and covers the lath and optionally sanded or ground.

Figure 3:
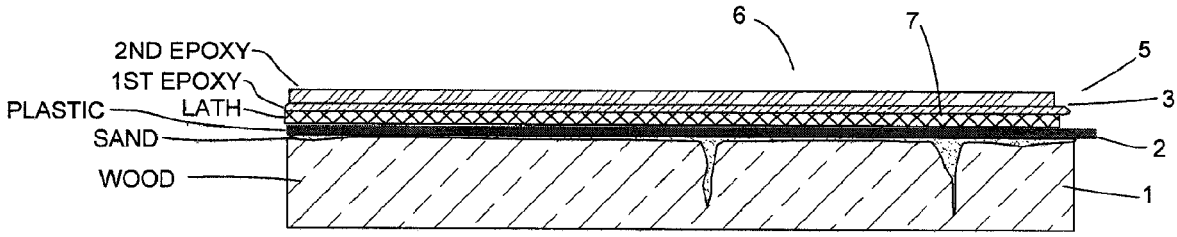
FIG. 3 shows an alternate embodiment with a plastic layer inserted between the wood and metal lath.

FIG. 3 shows an alternate embodiment of the present invention. Sand 2 is swept on top of the wood 1 to fill voids, and a layer of around 6 mil plastic 7 is placed on top of the wood 1. Different thicknesses of plastic can be used with around 6 mil being optimum. Then the lath 3 is stapled on top of the plastic with the staples extending into the wood. Then the first epoxy layer 5 and the second epoxy layer 6 can be installed. In either FIG. 3 or FIG. 2, the last epoxy finish layer 6 can be omitted if desired.

It is also possible in any of the described embodiments for the factory owner to cut trenches in the wooden floor before the job is started. This allows conduit and other piping to be laid out uniformly and in advance of installation of the epoxy. Compared to concrete floors, this is a benefit, since typically the utilities trenches are cut after installation of the concrete increasing cost, dust and manufacturing down time.

FIG. 4 lists five steps that make up a typically application of the method and system of the present invention. Step 5 can be omitted in some installations, and the first epoxy layer can be optionally ground or sanded after it is dry.

Several descriptions and illustrations have been provided to aid in understanding the present invention. One skilled in the art will realize that numerous changes and variations are possible without departing from the spirit of the invention. Each of these changes and variations is within the scope of the present invention.

I claim:

1. A method for covering a wood floor comprising:

sweeping a layer consisting essentially of sand over said wooden floor to fill voids or cracks;

fastening metal lath to said wooden floor after sweeping said sand;

applying a first layer of epoxy over said metal lath;

allowing said epoxy to cure.

2. The method of claim 1 further comprising sanding or grinding said first layer of epoxy after it cures.

3. The method of claim 1 further comprising applying a second layer of epoxy over said first layer.

4. The method of claim 1 wherein said metal lath is fastened to said floor with staples.

5. The method of claim 4 wherein said staples are 2 inch staples.

6. The method of claim 1 wherein said metal lath is 4.5 gauge metal.

7. The method of claim 1 wherein said epoxy is self-leveling of at least 15-16% elongation.

8. A method for covering a wooden floor comprising:

sweeping a layer consisting essentially of dry sand over said wooden floor to fill voids and cracks;

fastening metal lath to said wooden floor after sweeping said dry sand;

applying a first layer of epoxy over said metal lath;

allowing said first layer of epoxy to cure;

applying a second layer of epoxy over said first layer of epoxy.

9. The method of claim 8 further comprising sanding or grinding said first layer of epoxy after it cures before said second layer of epoxy is applied.

10. The method of claim 8 wherein said metal lath is fastened to said floor with staples.

11. The method of claim 10 wherein said staples are 2 inch staples.

12. The method of claim 8 wherein said lath is 4.5 gauge metal.

13. The method of claim 8 wherein said epoxy is self-leveling of at least 15-16% elongation.

14. A method for covering a wooden floor comprising:

sweeping a layer consisting essentially of sand over said wooden floor to fill voids and cracks;

fastening metal lath to said wooden floor;

applying a first layer of epoxy over said metal lath;

allowing said first layer of epoxy to cure;

sanding or grinding said first layer of epoxy;

applying a second layer of epoxy over said first layer of epoxy.

15. The method of claim 14 wherein said metal lath is fastened to said floor with staples.

16. The method of claim 14 wherein said staples are 2 inch staples.

* * * * *